US007976124B2

(12) United States Patent
Bisschop

(10) Patent No.: US 7,976,124 B2
(45) Date of Patent: Jul. 12, 2011

(54) INK JET DEVICE AND METHOD OF MANUFACTURING THE SAME

(75) Inventor: Jacobus J. M. Bisschop, Venlo (NL)

(73) Assignee: Oce-Technologies B.V., Venlo (NL)

( * ) Notice: Subject to any disclaimer, the term of this patent is extended or adjusted under 35 U.S.C. 154(b) by 1006 days.

(21) Appl. No.: 11/889,149

(22) Filed: Aug. 9, 2007

(65) Prior Publication Data

US 2008/0246805 A1 Oct. 9, 2008

(30) Foreign Application Priority Data

Aug. 11, 2006 (EP) ..... 06118790

(51) Int. Cl.
*B41J 2/135* (2006.01)

(52) U.S. Cl. ..... 347/44; 347/48; 347/74; 347/75; 347/84; 347/85

(58) Field of Classification Search ..... 347/44, 347/74–75, 84–85, 48
See application file for complete search history.

(56) References Cited

U.S. PATENT DOCUMENTS

| | | | | |
|---|---|---|---|---|
| 3,708,798 | A * | 1/1973 | Hildenbrand et al. | 347/86 |
| 4,005,435 | A * | 1/1977 | Lundquist et al. | 347/75 |
| 6,050,679 | A * | 4/2000 | Howkins | 347/72 |
| 6,921,159 | B2 * | 7/2005 | Sakamoto et al. | 347/70 |
| 7,677,708 | B2 * | 3/2010 | Kitamura et al. | 347/71 |
| 2002/0073543 | A1 | 6/2002 | Koda et al. | |

FOREIGN PATENT DOCUMENTS

| | | | |
|---|---|---|---|
| EP | 0563603 | A2 | 10/1993 |
| EP | 0820869 | A1 | 1/1998 |
| EP | 0956955 | A2 | 11/1999 |
| JP | 07-81058 | A | 3/1995 |
| JP | 7-276626 | A | 10/1995 |
| JP | 10-278263 | A | 10/1998 |
| JP | 11-342610 | A | 12/1999 |
| JP | 2003-039669 | A | 2/2003 |

* cited by examiner

*Primary Examiner* — Ryan Lepisto
*Assistant Examiner* — Guy G Anderson
(74) *Attorney, Agent, or Firm* — Birch, Stewart, Kolasch & Birch, LLP

(57) ABSTRACT

An ink jet device including a plurality of ink channels that are arranged side by side and are covered by a flexible sheet, and a corresponding number of actuators are arranged to exert an actuating force onto the sheet through a bump that has a trapezoidal cross-sectional configuration wherein the bumps are formed on the sheet in such an orientation that their trapezoidal cross-section diverges towards the actuator, and the bumps are bonded to the actuators by means of an adhesive.

6 Claims, 2 Drawing Sheets

INK JET DEVICE AND METHOD OF MANUFACTURING THE SAME

This application claims priority from European Patent Application No. 06118790.2 filed on Aug. 11, 2006, the entire contents of which is hereby incorporated by reference.

BACKGROUND OF THE INVENTION

The present invention relates to an ink jet device comprising a number of ink channels that are arranged side by side and are covered by a flexible sheet, and a corresponding number of actuators that are arranged to exert an actuating force onto the sheet through a bump having a surface facing the actuator and a surface facing the sheet, wherein the bumps are formed on the sheet in such an orientation that the surface facing the actuator has an area larger than the area of the surface facing the sheet and the bumps are bonded to the actuators by means of an adhesive. The present invention further relates to a method of manufacturing such an ink jet device.

JP 2003039669A discloses an ink jet device of the type indicated above, wherein the bumps have a T-shaped cross-section.

JP 7-276 626 A discloses an ink jet device wherein the ink channels, the flexible sheet and the bumps are formed by etching a silicon substrate. The bumps have a trapezoidal cross-section, the larger base of which is facing the sheet, so that the bump tapers towards the actuator.

EP 0 820 869 A1 discloses an ink jet device wherein the ink channels are formed in a channel plate on which the flexible sheet is superimposed as a separate member. The sheet is formed with an array of parallel grooves, so that ridges formed between the adjacent grooves serve as bumps that project towards the actuators. The grooves have a half-circular cross-section, so that the bumps have arcuate flanks and taper towards the actuators. The actuators are formed by piezoelectric fingers, and the tip end of each finger is bonded to an associated one of the bumps by means of an adhesive. Each ink channel is connected to a nozzle through which an ink droplet is to be jetted out. In order to create an ink droplet that is expelled from the nozzle, the piezoelectric actuator is at first energized to perform a contraction stroke, so that the portion of the flexible sheet covering the associated ink channel is drawn away from the ink channel. As a result, the volume of the ink channel increases and a corresponding amount of ink is sucked in from an ink supply system. Then, the actuator is energized with an opposite polarity, so that it performs an expansion stroke and deflects the sheet into the ink channel. In this way, an acoustic pressure wave is generated in the ink channel, and this pressure wave propagates towards the nozzle and causes an ink droplet to be expelled.

A general problem that is encountered in conjunction with ink jet devices of this type is the so-called cross-talk phenomenon. This means that the process of droplet generation in one channel also influences the ink in the neighbouring channels and therefore disturbs the drop generation processes in the neighbouring channels. One of the reasons is that the deflections of the sheet cannot strictly be confined to an individual ink channel but are accompanied by slight deflections of those portions of the sheet that cover the neighboring channels.

SUMMARY OF THE INVENTION

It is an object of the present invention to provide an ink jet device with reduced cross-talk.

In the ink jet device according to the present invention, the bumps have a trapezoidal cross-section and are formed on the sheet in such an orientation that their trapezoidal cross-sections diverge towards the actuators. It has been found that one of the reasons for the undesired cross-talk phenomenon in conventional ink jet devices is due to the fact that the spatial distribution of adhesive that is needed for bonding the actuators to the bumps cannot be controlled with sufficient accuracy. More specifically, this adhesive is not confined to the faces of the bumps and the actuators that are bonded together, but rather is squeezed out and forms beads along the edges of the actuators and bumps and is likely to contact the surface of the sheet itself, with the result that the stiffness of the flexible sheet is influenced in an uncontrollable manner. In the device according to the present invention, however, the surface of the bump that is bonded to the actuator corresponds to the larger side of the trapezoidal cross section of the bump and forms an acute angle with the tapering side faces of the bump. It has been found that this prevents the adhesive from flowing around the sharp edge of the bump and from reaching the surface of the flexible sheet at the narrower base of the bump. Thus, the adhesive has practically no influence on the stiffness of the flexible sheet which is determined only by the contact area between the relatively narrow base of the bump and the surface of the sheet.

The present invention has the further advantage that the relatively large surface of the bump that is facing the actuator permits larger tolerances to compensate for the positioning and the shapes of the actuators, whereas the relatively narrow contact area between the bumps and the sheet increases the overall flexibility of the sheet and helps to confine the deflections of the sheet, so that the cross-talk tendency is further reduced.

In a preferred embodiment, the bumps are made of metal, e.g., copper. When the actuators are piezoelectric actuators, the copper bumps may, at the same time, serve electrodes for creating an electric field that causes the piezoelectric material to expand and contract. The width of the bump surface that faces the actuator is preferably larger than the width of the actuator itself.

In a preferred embodiment, the flexible sheet is formed by a foil of plastic material, e.g., a polyimide, and the bumps are formed by coating the foil with a copper layer from which the bumps are formed by photolithographic techniques. Isotropic etching then gives the desired trapezoidal shape of the bumps.

BRIEF DESCRIPTION OF THE DRAWINGS

A preferred embodiment of the present invention will now be described in conjunction with the drawings, wherein.

DETAILED DESCRIPTION OF THE DRAWINGS

Figure 1:
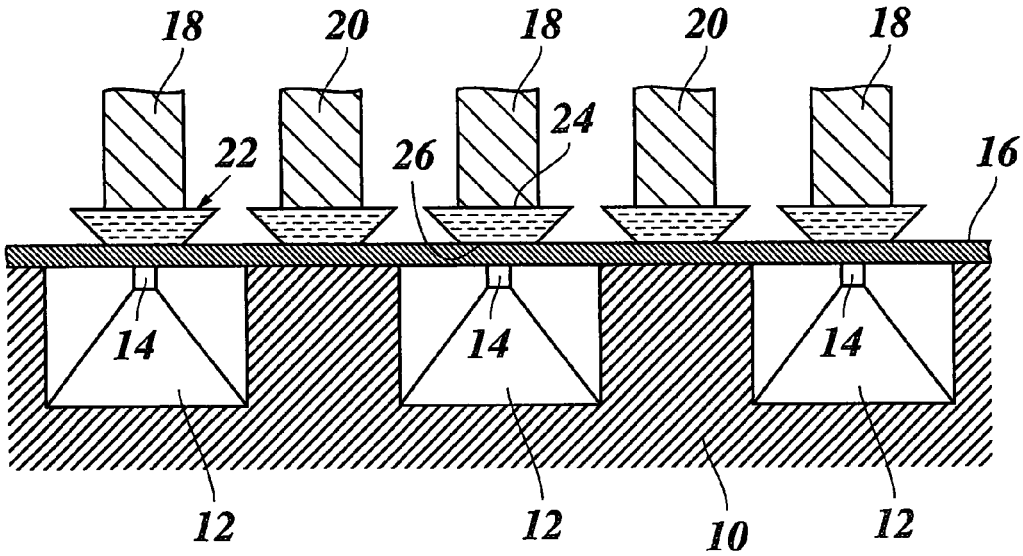
FIG. 1 is a schematic cross-sectional view of an ink jet device according to the invention.

The ink jet device shown in FIG. 1 comprises a channel plate 10 that is made of graphite, for example, and forms a large number of parallel ink channels 12. The ink channels 12 are shown in cross-section in FIG. 1 and are cut into a surface of the channel plate 10, so that in the orientation shown in FIG. 1 they form the top surface. Each ink channel 12 converges to a nozzle 14 from which an ink droplet is to be expelled. In a practical embodiment, the distance between two neighbouring nozzles 14 may for example amount to 340 μm, corresponding to a print resolution of 75 dpi for a single row of nozzles 14.

The ink channels 12 are open to the top surface of the channel plate 10 and are covered by a continuous flexible sheet 16 that is formed, for example, by a polyimide foil with a thickness of 12.5 μm.

An actuator 18 is disposed above each of the ink channels 12. The actuators 18 are formed by piezoelectric fingers that extend in parallel with the ink channels 12 (normal to the plane of the drawing in FIG. 1) and are arranged alternatingly with support fingers 20 which are also made of piezoelectric material. Together with the actuators 18, the support fingers 20 may form a one-piece actuator block with a comb-like structure.

Each actuator 18 and each support finger 20 is connected to the flexible sheet 16 through a bump 22 that is made of copper. The bumps 22 have a cross-sectional shape of an isosceles trapezoid defining parallel top and bottom surfaces 24, 26. The trapezoid is oriented such that the larger top surface 24 faces the lower end of the actuator 18 and the support finger 20, respectively. The sides of the trapezoidal bumps 22 are inclined at an angle between 40 and 50°. Thus, the width of the top surface 24 of each bump will be approximately twice the width of the bottom surface 26. For example, the width of the top surface 24 may be approximately 125 mm, whereas the width of the bottom surface will only be in the order of 65 mm. The width of the top surface 24 is larger than the width of the actuators 18 and support fingers 20, so that each bump projects beyond the corresponding actuator or support finger by an amount of approximately 15-35 mm on either side. The height of the bumps 22 may be in the range from 15 to 30 mm, for example.

Figure 2:
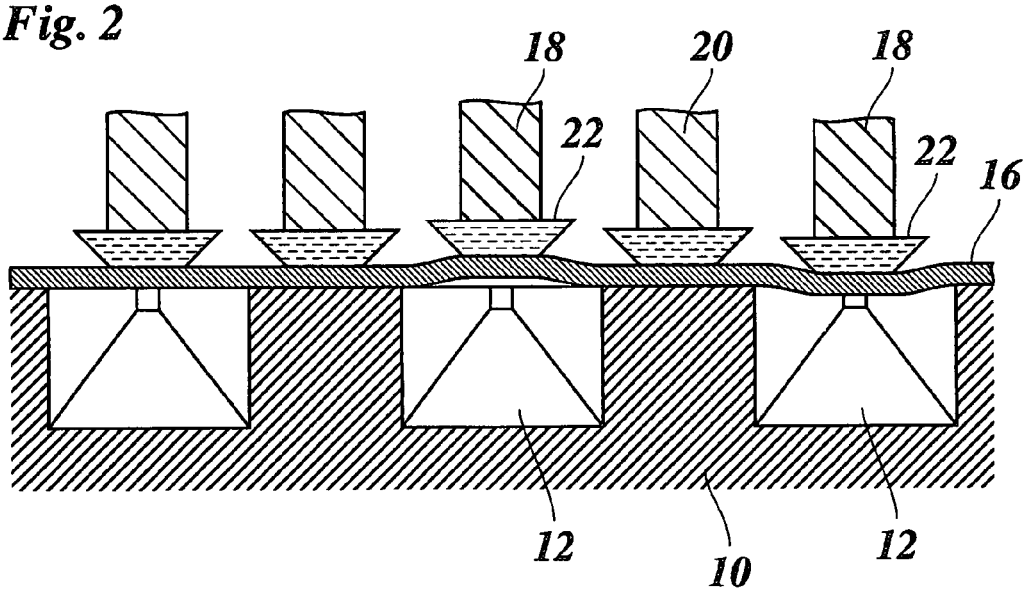
FIG. 2 shows the device of FIG. 2 in an active state.

When an ink droplet is to be expelled from one of the nozzles 14, the corresponding piezoelectric actuator 18 is first energized to perform a contraction stroke, so that the corresponding portion of the sheet 16 is lifted away from the ink channel 12, as has been shown for the central ink channel 12 in FIG. 2. As a result, the volume of the ink channel 12 is increased, and a certain amount of ink will be sucked in. Then, the actuator is caused to perform an expansion stroke, so that the sheet 16 is depressed into the ink channel 12, as has been shown for the right ink channel 12 in FIG. 2. In this way, the mechanical energy of the actuator 18 is efficiently transformed into acoustic energy of a pressure wave that propagates through the ink in the ink channel 12 towards the nozzle 14, where an ink droplet is jetted out.

The support fingers 20 have the purpose to rigidly connect the actuator block to the channel plate 10 and to absorb the reaction forces of the actuators 18.

Since the flexible sheet 16 must necessarily have a certain rigidity, the deflections of the sheet in the regions above the ink channels 12 will create mechanical stresses within the sheet 16, which will spread out through the sheet and will have a tendency to deflect or bias the sheet also in the portions above neighboring ink channels. As a result, the drop generation processes in the neighboring ink channels 12 will have a tendency to interfere with one another, a phenomenon that is known a cross-talk.

In this context, the cross-sectional shape of the bumps 22 has the advantage that the contact area between the bump 22 and the sheet 16 is reduced, so that the sheet retains a relatively high flexibility, and cross-talk is reduced. On the other hand, the larger width of the top surfaces 24 of the bumps 22 permits absorbing manufacturing and/or positioning tolerances of the actuators 18. In this respect, it is particularly advantageous that the width of the top surfaces 24 of the bumps is larger than the width of the actuators 18.

Figure 3:
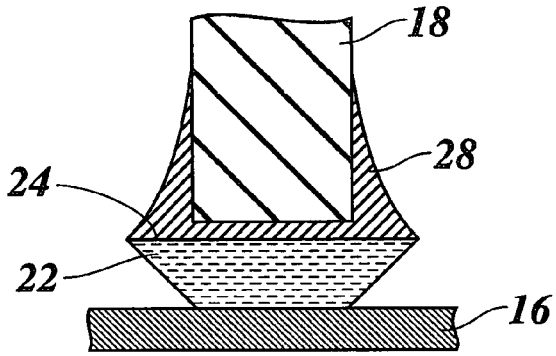
FIG. 3 is an enlarged cross-sectional view of an actuator and a bump in the device shown in FIGS. 1 and 2.

This configuration has another significant advantage that will now be explained in conjunction with FIG. 3. In order for the actuator 18 to be able to draw the sheet 16 away from the ink channel 12 during its contraction stroke, the lower end of the actuator 18 must be rigidly connected to the bump 22 which itself is rigidly connected to the sheet 16. As is shown in FIG. 3, the actuator 18 is bonded to the bump 22 by means of an adhesive 28. This adhesive, which will be in the liquid state before it is cured, will have a tendency to flow along the surfaces of the actuator 18 and the bump 22 due to capillary forces. Moreover, when the actuator 18 is pressed against the bump 22 during the bonding process, the adhesive 28 will be squeezed out on both sides of the actuator 18. Thanks to the trapezoidal cross-sectional shape of the bump 22, the meniscus of the adhesive 28 will assume the configuration shown in FIG. 3, i.e., the adhesive will tend to flow upwards along the lateral surfaces of the actuator 18 and sidewards along the top surface 24 of the bump 22, but it will hardly flow around the relatively sharp edges formed at the top corners of the trapezoidal cross-section. Thus, the adhesive 28 is efficiently prevented from coming into contact with the surface of the sheet 16, and, as a result, even when the adhesive 28 is cured, it will not increase the rigidity of the flexible sheet 16. This effect contributes significantly to the suppression of cross-talk.

Figure 4:
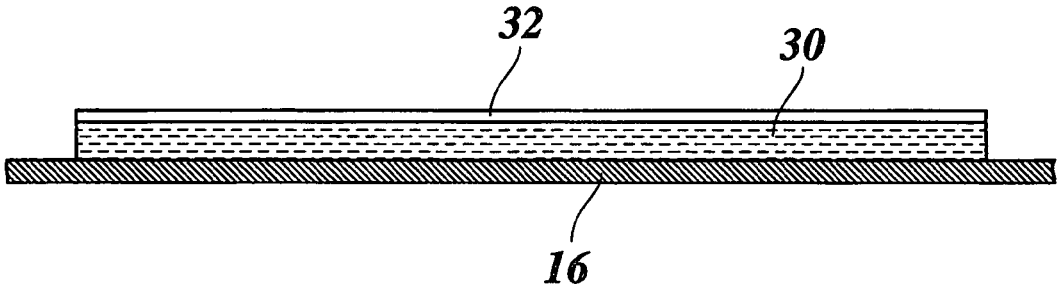
FIGS. 4 to 6 are sketches illustrating a method of manufacturing the ink jet device shown in FIG. 1.

A preferred method for manufacturing the ink jet device that has been described above will now be explained in conjunction with FIGS. 4 to 6. As is shown in FIG. 4, a uniform layer 30 of copper is formed on the top surface of the sheet 16, e.g., by electroplating or rolling. The thickness of the layer 30 corresponds to the height of the bumps 22 to be formed. Then, the top surface of the copper layer 30 is coated with a lacquer 32 for photolithography.

Figure 5:
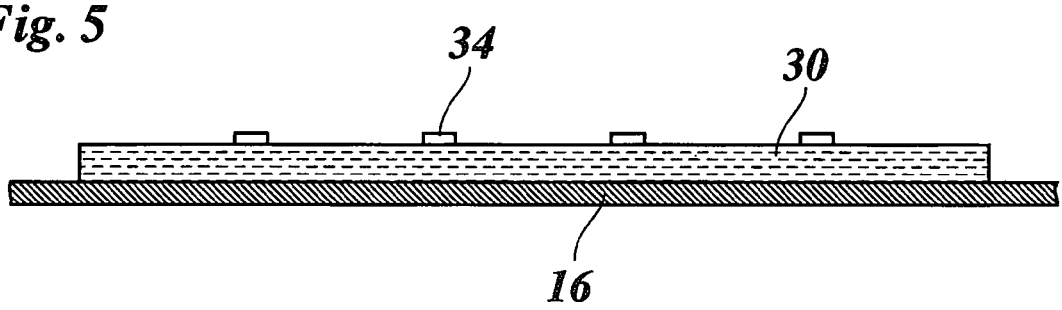

Then, as is well known in the art of photolithography, the lacquer 32 is exposed with light in order to form a pattern of parallel stripes, and either the exposed or the non-exposed portions of the lacquer are removed, so that the lacquer 32 remaining on the copper layer 30 forms a pattern of parallel stripes 34, as has been shown in FIG. 5. These stripes 34 will correspond to the gaps between the adjacent bumps 22.

Figure 6:
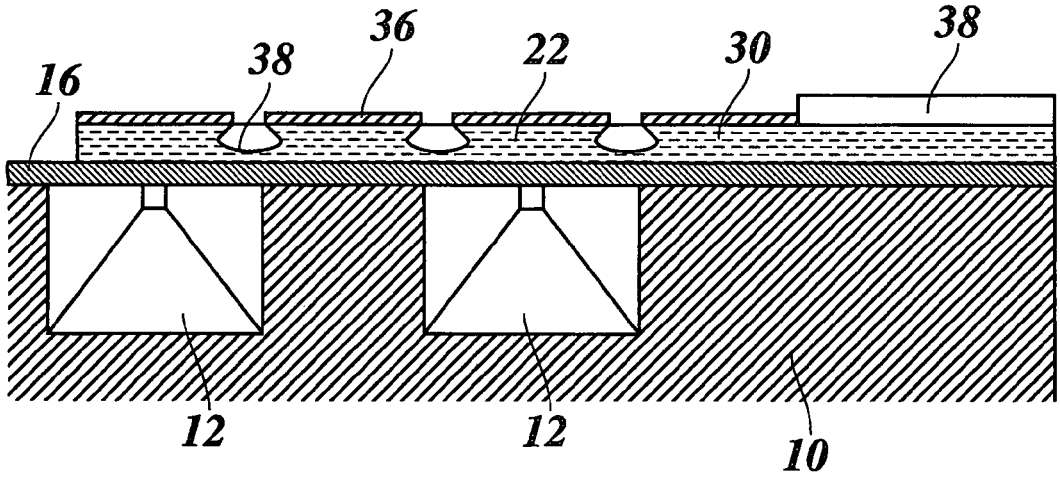

As is shown in FIG. 6, an etching mask 36 which may be formed by a thin layer of gold is deposited on those surface portions of the copper layer 30 that are not covered by the stripes 34, and the lacquer stripes 34 are removed. The etching mask 36 corresponds to a pattern of stripes the width of which corresponds to the width of the top surfaces 24 of the bumps 22.

In FIG. 6, the flexible sheet 16 has also been superposed on the channel plate 10 and has been bonded thereto, e.g., by means of an adhesive.

As has been shown schematically in FIG. 6, a part of the copper layer 30 in an edge portion of the channel plate 10 is brought into electric contact with a conductor sheet 38 that will later serve for contacting ground electrodes of the piezoelectric actuators 18. In this way, it is possible to apply an electric voltage to the copper layer 30. Then, the channel plate 10 with the sheet 16 mounted thereon is immersed into an etching solution, and the copper layer 30 is etched away in those portions that are not covered by the mask 36. The etching front 38 proceeds isotropically from the gaps between the stripes of the mask 36 and will finally reach the surface of the sheet 16. In this way, the bumps 22 with the desired trapezoidal shape are formed by isotropic etching of the copper layer 30. Finally, the actuators 18 and the support fingers

20 are bonded to the bumps 22 by means of the adhesive 28, so that one obtains the ink jet device shown in FIG. 1.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. An ink jet device comprising a plurality of ink channels that are arranged side by side and are covered by a flexible sheet, and a corresponding number of actuators that are arranged to exert an actuating force onto the sheet through a bump having a surface facing the actuator and a surface facing the sheet, wherein the bumps are formed on the sheet in such an orientation that the surface facing the actuator has an area larger than the area of the surface facing the sheet and the bumps are bonded to the actuators by means of an adhesive, wherein the bumps have a trapezoidal cross-section and are formed on the sheet in such an orientation that their trapezoidal cross-section diverges towards the actuator.

2. The ink jet device according to claim 1, wherein the bumps are made of metal.

3. The ink jet device according to claim 2, wherein the bumps are made of copper.

4. The ink jet device according to claim 1, wherein the surface of the bump facing the actuator has a width that is larger than the width of the actuator.

5. The ink jet device according to claim 1, wherein the surface of the bump facing the actuator has a width that is at least 1.5 times the width of the surface of the bump facing the sheet.

6. A method of manufacturing an ink jet device which comprises the steps of:

coating a flexible sheet with a layer of metal, applying a mask on the surface of the metal layer;

forming bumps with a trapezoidal cross-sectional configuration by isotropic etching of the metal layer; and bonding actuators to the bumps by means of an adhesive, wherein the trapezoidal cross-sectional configuration of the bumps adopts an orientation such that their cross-sections diverge towards the actuators.

* * * * *